US005584741A

United States Patent [19]

Cheung

[11] Patent Number: 5,584,741

[45] Date of Patent: Dec. 17, 1996

[54] HALLOWEEN TOY

[75] Inventor: Chik-Ting Cheung, Kowloon, Hong Kong

[73] Assignee: Seven Seas Plastic Fty Ltd., Hong Kong

[21] Appl. No.: 445,504

[22] Filed: May 22, 1995

[51] Int. Cl.[6] ..... A63H 3/28; A63H 3/26; A63H 11/06

[52] U.S. Cl. ..... 446/300; 446/337; 446/300; 40/414; 472/70; 74/38

[58] Field of Search ..... 446/300, 337, 446/352, 353, 358, 308, 309, 310, 311, 272, 298; 40/414, 411; 472/51, 70, 71, 76, 77, 78; 74/38

[56] References Cited

U.S. PATENT DOCUMENTS

| | | | |
|---|---|---|---|
| 222,872 | 12/1879 | David | 74/38 |
| 512,844 | 1/1894 | Simon | 74/38 X |
| 2,593,188 | 4/1952 | Rikelman | 472/51 X |
| 3,174,347 | 3/1965 | Hecht | 74/38 |
| 3,426,635 | 2/1969 | Nicklasson | 74/38 X |
| 4,272,916 | 6/1981 | Giordano et al. | 446/454 X |
| 4,662,856 | 5/1987 | Getgey et al. | 446/337 X |
| 5,393,259 | 2/1995 | Lee | 40/414 X |
| 5,413,518 | 5/1995 | Lin | 446/454 |

*Primary Examiner*—Robert A. Hafer
*Assistant Examiner*—D. Neal Muir
*Attorney, Agent, or Firm*—Burns, Doane, Swecker & Mathis

[57] ABSTRACT

A Halloween toy comprises an image member received within a frame. A mechanism is provided for moving the member into and out of the frame so as to achieve a scary effect. The image member may represent a face and movement of the member may be accompanied by light and sound effects. The image member may be covered by a sheet of material such that it is not readily visible when received within the frame but becomes visible when it it projects out of the frame. The mechanism for moving the image member is designed so as to occupy only a minimum of space.

5 Claims, 4 Drawing Sheets

HALLOWEEN TOY

FIELD OF THE INVENTION

This invention relates to a decorative toy, and in particular to a decorative toy for use at Halloween.

BACKGROUND OF THE INVENTION

A large number of toys and decorative items are known for use at Halloween. Such items are generally designed on themes of ghosts, witchcraft, evil spirits and the like. These items are intended to (mildly) scare people and generally add to the atmosphere at Halloween. Examples of such toys traditionally include costumes, masks, skeletons and the like.

A disadvantage of such traditional toys is that they are static and they generally rely on a user to provide the movement necessary to create an appropriately chilling effect. There is accordingly a need for more toys that create an appropriately chilling effect on their own, and especially to such toys that do not need the presence of a user so that they can create an even greater effect on a third party by the element of surprise.

SUMMARY OF THE INVENTION

According to the present invention there is provided a toy comprising, a frame, an image member generally received within said frame, and means for moving said image member between a first position in which said image member lies substantially within a plane defined by said frame, and a second position in which said image member projects out of said frame.

The image member may, for example, be representative of a face or a skull and the effect of the movement between the first and second positions will be to cause the image member to "jump out" of the frame at a viewer. The effect of this may be enhanced if the image member is covered by a sheet of material such that when it is in the first position it is not visible but only becomes visible through the material when it moves into its second position.

The scaring effect may be further increased if the toy is provided with sound and light generating means that are linked to the movement of the image member. For example, if the image member represents a face or a skull lights may be provided to represent flashing or illuminated eyes, while sound generating means may be used to represent a voice, laughter or appropriate sound effects.

Preferably the toy may be provided with sensing means capable of sensing the presence of a person and may be adapted to operate in the presence of a person so that the toy will operate automatically when a person is present.

The toy is designed to be hung from a vertical surface, such as a wall or a door, somewhat in the manner of a picture, and as such the toy should be relatively thin compared to its width and height. This presents difficulty in the design of the means for moving the image member between its first and second positions. The moving means must be receivable and operable in a narrow confined space.

In a preferred embodiment the moving means comprises a first lever arm pivotably secured at one end to said frame, a second lever arm pivotably secured at one end to said image member, said first and second lever arms being pivotably connected together at their other ends, and means for acting upon said first lever arm to cause rotation of said first lever arm.

With such an arrangement when the image member is received within the frame the first and second lever arms lie generally parallel and adjacent each other, or at least at a narrow angle relative to each other. Upon rotation of said first arm said arms move apart and an angle is opened up between them and the image member is pushed away from the frame. In the position of maximum extension of the image member from the frame the two lever arms will be aligned together at right angles to the frame.

Preferably the means for acting on the first lever arm comprises a third lever arm one end of which is pivotably mounted to a point on said first lever arm and the other end of which is pivotably eccentrically mounted on a drive wheel.

Preferably the toy is provided with a plurality, for example four, of such means for moving the image member.

BRIEF DESCRIPTION OF THE DRAWINGS

An embodiment of the invention will now be described by way of example and with reference to the accompanying drawings, in which.

DETAILED DESCRIPTION OF PREFERRED EMBODIMENT

Figure 1:
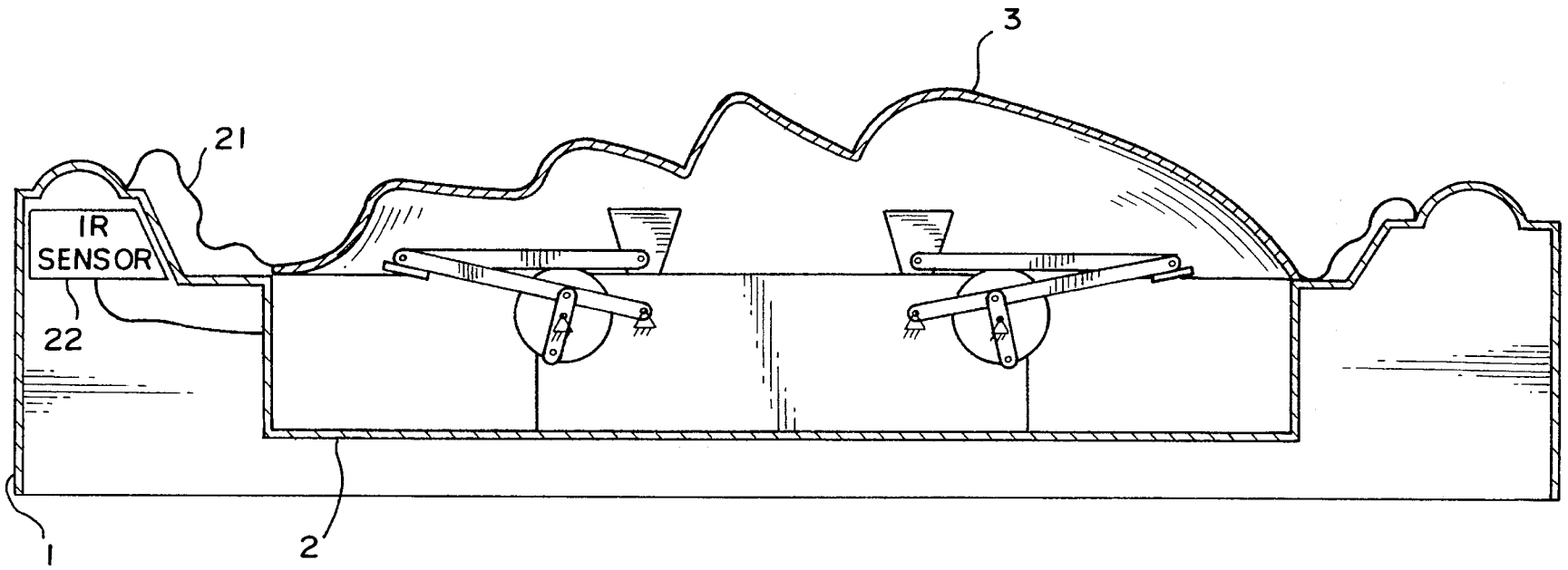
FIG. 1 is a side view in cross-section showing a first embodiment of the invention with the image member in its first position received within the frame.

Referring firstly to FIG. 1 there is shown a first embodiment of the invention comprising a rectangular frame 1 having a recessed base portion 2. Received within the boundaries of the frame 1 and overlying the base portion 2 is an image member 3. In this embodiment the image member takes the form of a representation of a face.

Figure 2:
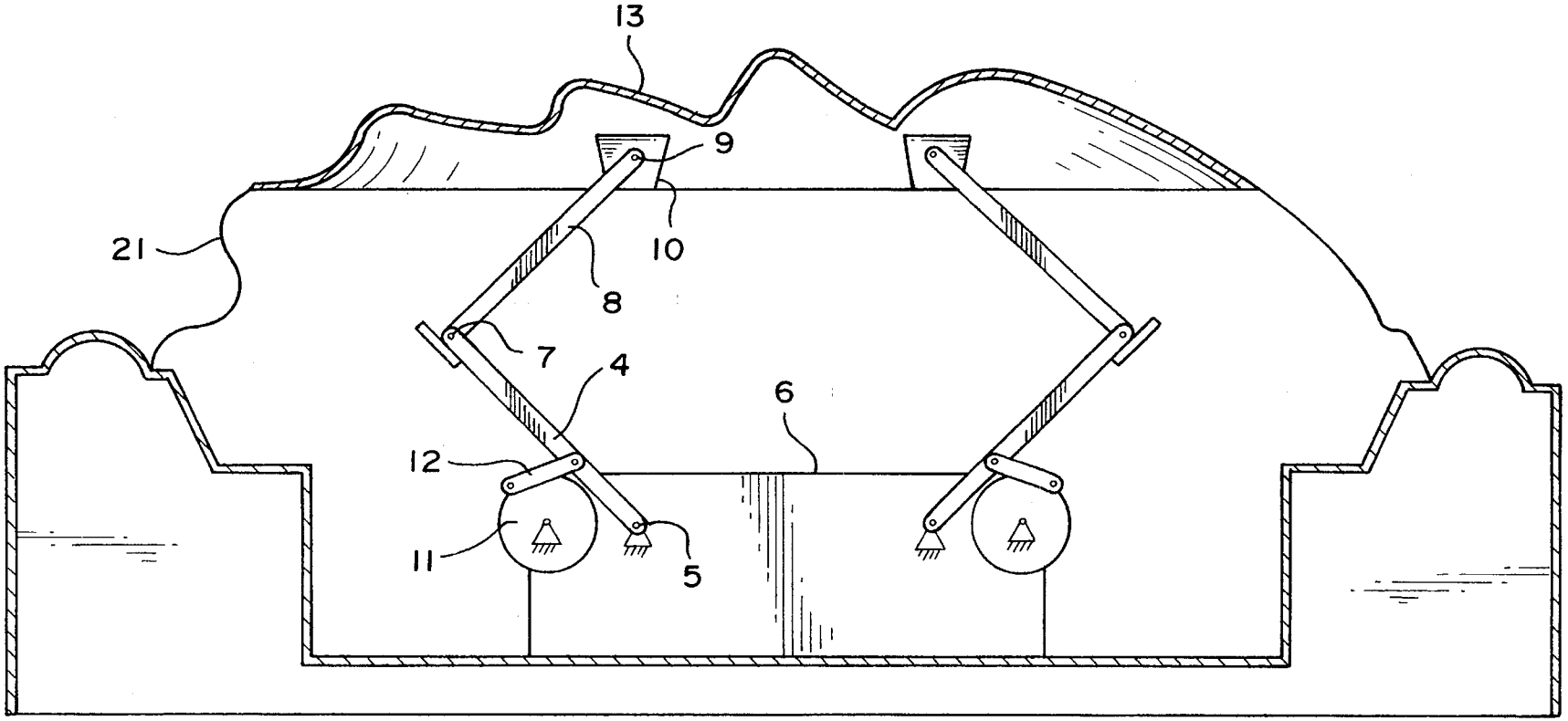
Fig.2 is a view similar to FIG. 1 but showing the image member in a position intermediate its first and second positions.
Figure 3:
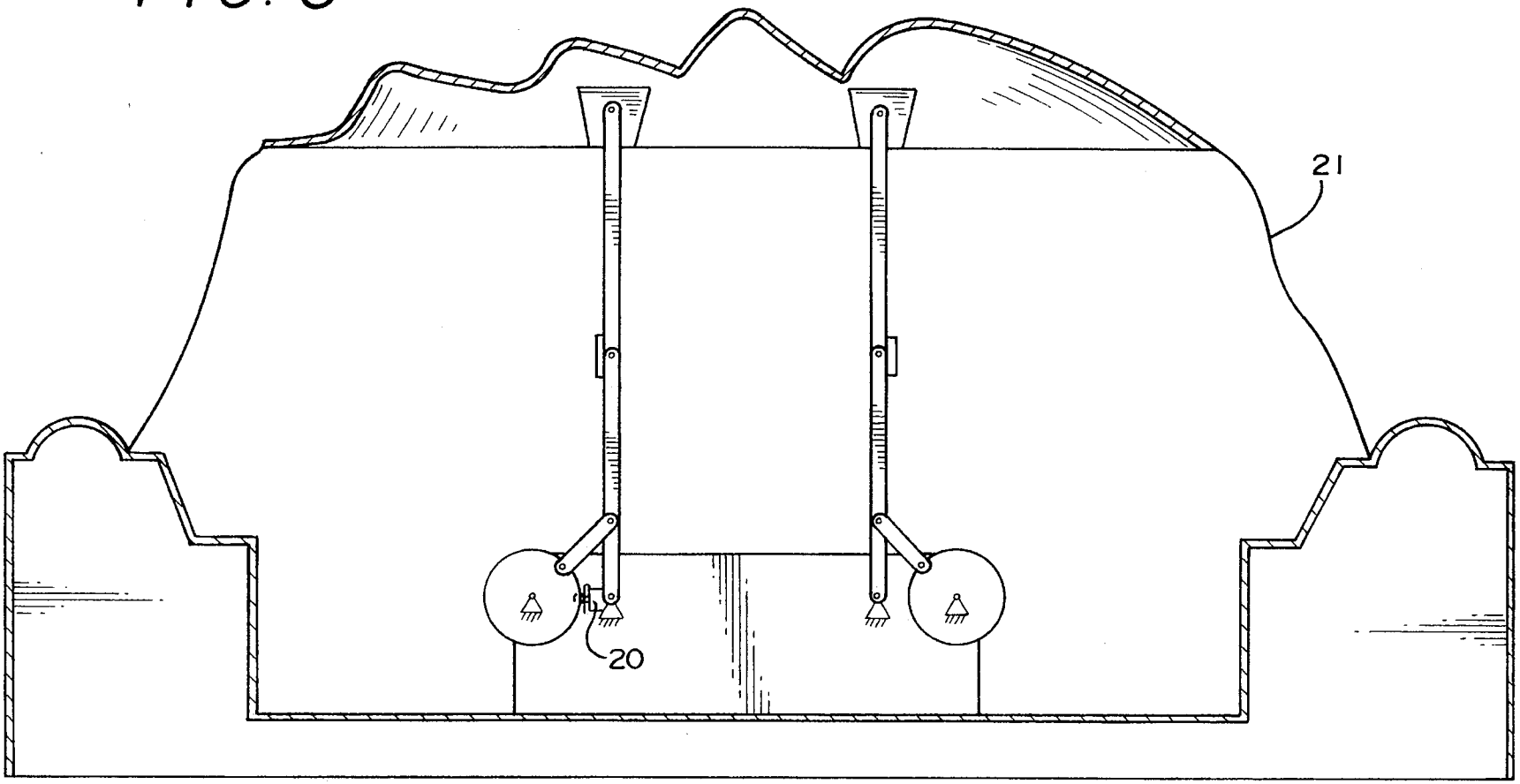
Fig.3 is a view similar to Figs.1 & 2 but showing the image member in its second position.
Figure 4:
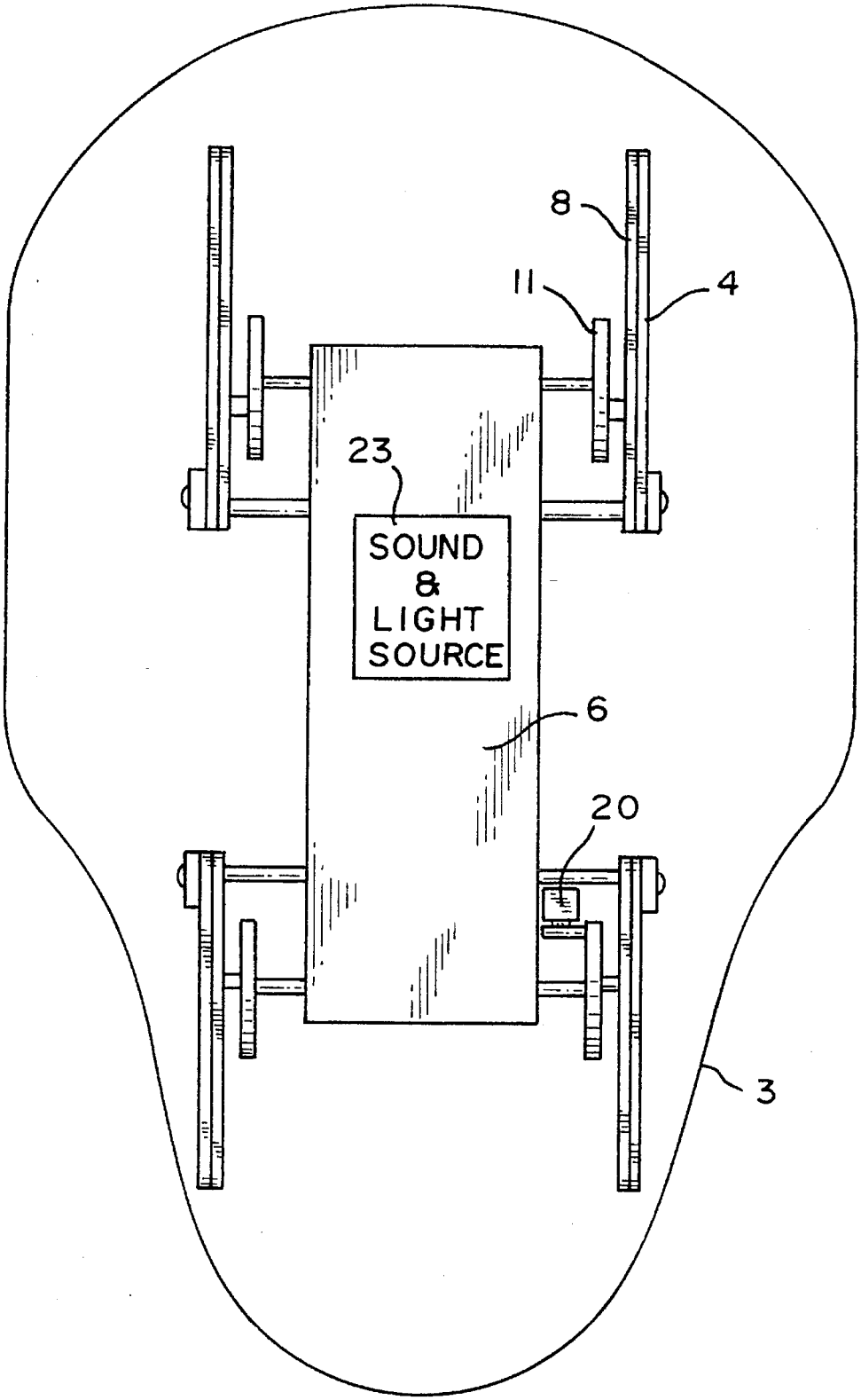
Fig.4 is a plan view of the embodiment of FIGS. 1 to 3.

Housed within the base portion 2 is a drive mechanism for moving the image member 3 relative to the frame 1 in a manner to be described hereinafter. As will be seen in particular from Fig.4 the drive means comprises four individual drive mechanisms, only two of which are shown in FIGS. 1 to 3, all of which are identical and only one of which therefor will be described in any detail.

For the sake of clarity the drive mechanism is best described with reference to FIG. 2. Each drive mechanism comprises a first lever arm 4 pivotably mounted at one end 5 to a support housing 6 integrally formed as part of the frame 1. The other end 7 of the first lever arm 4 is pivotably connected to a second lever arm 8 the other end 9 of which is in turn pivotably connected to a support 10 formed on the underside of the image member 3.

All four drive mechanisms are driven from a single electric motor (not shown) which is housed within the support housing 6 and are driven from the motor by appropriate gearing. At the output of the drive from the motor are provided four drive wheels 11, one associated with each drive mechanism, which act upon the first lever arms 4 in the manner to be described so as to move the image member 3 between its first and second positions.

Pivotably mounted at one end to each drive wheel 11 is a third lever arm 12. The mounting point of the third lever arm on the drive wheel 11 is at an eccentric location. The other end of the third lever arm is pivotably fixed to a point between the two ends of the first lever arm 4. Operation of the drive mechanisms will now be described in more detail and with reference to FIGS. 1 to 3.

Upon operation of the drive motor the drive wheels are caused to rotate. The two drive mechanisms shown in FIGS. 1 to 3 are symmetrically disposed and thus the two drive wheels shown in FIGS. 1 to 3 rotate in opposite directions. The drive wheel on the left-hand side of the figures rotates clockwise, while the drive wheel on the right-hand side rotates in an anti-clockwise sense.

Since the third lever arm 12 is mounted eccentrically to the drive wheel 11 rotation of the drive wheel 11 causes the third lever arm to exert a torque on the first lever arm 4, and the first lever ann 4 is caused to rotate in the same sense as the drive wheel and thus increases the angle between the first and second lever arms. As the first and second lever arms move apart the image member 3 is caused to move away from the frame 1. This is best seen in FIG.2.

After continued rotation of the drive wheel 11 a point is reached in which the first and second lever arms are in alignment (FIG.3). This corresponds to the second position of the image member 3 in which the image member is at its maximum projection out of the frame. At this point a switch 20 is activated and rotation of the drive wheels is temporarily paused and then re-started but in the opposite direction. This causes the movement of the lever arms to be reversed and the image member is retracted into the frame. The cycle may then be repeated if desired.

Covering the opening defined by the frame 1, and therefore the image member, 3 is a piece of fabric material 21. This piece of material 21 is much larger than the opening of the frame so that when the image member is in its first position (FIG.1) it covers the image member loosely such that the image member is not apparent. However upon movement of the image member into its second position (FIG.3) the fabric material 21 is stretched relatively tightly over the image member so that the image member becomes visible.

Operation of the toy may be activated by a user, or it may be activated automatically in response to the presence of a third party. For example the toy may be provided with a sensor 22, for example an infra-red sensor, that detects the presence of a person nearby and thus initiates operation of the toy. In addition the toy may be provided with sound and light generating means 23 such that movement of the image member may be accompanied by appropriate sound and light effects —for example hollow laughter and red flashing eyes.

I claim:

1. A toy comprising, a frame, an image member generally received within said frame, and means for moving said image member between a first position in which said image member lies substantially within a plane defined by said frame, and a second position in which said image member projects out of said frame, wherein said moving means comprises a plurality of first lever arms each pivotally secured at one end thereof to said frame, a plurality of a second lever arms each pivotally secured at one end thereof to said image member, with respective ones of said first and second lever arms being pivotally secured together at their other ends, and a plurality of third lever arms each having one end which is pivotally mounted to a point intermediate the two ends of a respective said first lever arm and another end which is pivotally and eccentrically mounted on a drive wheel.

2. A toy as claimed in claim 1 wherein said image member is covered by a sheet of material.

3. A toy as claimed in claim 2 wherein said sheet of material is of such a size that when said image member is in its first position it is not visible, and when said image member is in its second position at least its shape is visible through said sheet of material.

4. A toy as claimed in claim 1 further comprising sound and light generating means linked to movement of said image member.

5. A toy as claimed in claim 1 further comprising means for sensing the presence of a person and activating said moving means when the presence of a person is sensed.

* * * * *